US007223064B2

(12) United States Patent
Hablanian

(10) Patent No.: US 7,223,064 B2
(45) Date of Patent: May 29, 2007

(54) BAFFLE CONFIGURATIONS FOR MOLECULAR DRAG VACUUM PUMPS

(75) Inventor: Marsbed Hablanian, Wellesley, MA (US)

(73) Assignee: Varian, Inc., Palo Alto, CA (US)

( * ) Notice: Subject to any disclaimer, the term of this patent is extended or adjusted under 35 U.S.C. 154(b) by 187 days.

(21) Appl. No.: 11/053,560

(22) Filed: Feb. 8, 2005

(65) Prior Publication Data

US 2006/0177300 A1 Aug. 10, 2006

(51) Int. Cl.
*F01D 1/36* (2006.01)

(52) U.S. Cl. ..... 415/90

(58) Field of Classification Search ..... 415/90
See application file for complete search history.

(56) References Cited

U.S. PATENT DOCUMENTS 5,074,747 A 12/1991 Ikegami et al.
5,154,572 A * 10/1992 Toyoshima et al. ..... 415/90
5,238,362 A 8/1993 Casaro et al.
5,709,528 A * 1/1998 Hablanian ..... 415/90
5,848,873 A 12/1998 Scholfield
6,135,709 A 10/2000 Stones
6,866,488 B2 * 3/2005 Olivier et al. ..... 417/423.4
6,877,949 B2 4/2005 Cerruti et al.

FOREIGN PATENT DOCUMENTS

GB 2 333 127 A 7/1999
JP 63 280893 A 11/1988

* cited by examiner

*Primary Examiner*—Edward K. Look
*Assistant Examiner*—Devin Hanan
(74) *Attorney, Agent, or Firm*—Bella Fishman

(57) ABSTRACT

A molecular drag compressor includes a rotor disk coupled to a drive shaft for rotation about an axis, a stator disposed about the rotor disk, the stator defining a tangential flow channel, an inlet to the tangential flow channel and an outlet from the tangential flow channel, and a stationary baffle disposed in the tangential flow channel adjacent to the outlet. The baffle and the rotor disk have a gap between them. A surface of the baffle facing the rotor disk has cavities configured to produce turbulent gas flow through the gap between the baffle and the rotor disk and to thereby reduce leakage.

17 Claims, 5 Drawing Sheets

BAFFLE CONFIGURATIONS FOR MOLECULAR DRAG VACUUM PUMPS

FIELD OF THE INVENTION

This invention relates to vacuum pumps used for evacuating an enclosed vacuum chamber and, more particularly, to baffle configurations for molecular drag vacuum pumping stages of a vacuum pump. The molecular drag pumping stages can be utilized in hybrid turbomolecular vacuum pumps, but are not limited to such applications.

BACKGROUND OF THE INVENTION

Conventional turbomolecular vacuum pumps include a housing having an inlet port, and interior chamber containing a plurality of axial pumping stages, and an exhaust port. The exhaust port is typically attached to a roughing vacuum pump. Each axial pumping stage includes a stator having inclined blades and a rotor having inclined blades. The rotor and stator blades are inclined in opposite directions. The rotor blades are rotated at high speed to provide pumping of gases between the inlet port and the exhaust port. A typical turbomolecular vacuum pump may include 9 to 12 axial pumping stages.

Variations of the conventional turbomolecular vacuum pump, often referred to as hybrid vacuum pumps, are known in the prior art. In one prior art configuration, one or more of the axial pumping stages are replaced with molecular drag stages which form a molecular drag compressor. This configuration is disclosed in U.S. Pat. No. 5,238,362, issued Aug. 24, 1993 to Casaro et al. A hybrid vacuum pump including an axial turbomolecular compressor and a molecular drag compressor in a common housing is sold by Varian, Inc. Other hybrid vacuum pumps are disclosed in U.S. Pat. No. 5,074,747 issued Dec. 24, 1991 to Ikegami et al.; U.S. Pat. No. 5,848,873 issued Dec. 15, 1998 to Schofield; and U.S. Pat. No. 6,135,709 issued Oct. 24, 2000 to Stones.

Molecular drag compressors include a rotor disk and a stator. The stator defines a tangential flow channel and an inlet and an outlet of the tangential flow channel. A stationary baffle, often called a stripper, is disposed in the tangential flow channel and separates the inlet and the outlet. As known in the art, the momentum of the rotor disk is transferred to gas molecules within the tangential flow channel, thereby directing the molecules toward the outlet. The rotor disk and the stator of the molecular drag compressor are separated by a small gap, typically on the order of 0.005 inch, selected to permit unrestricted rotation of the disk, while limiting leakage through the gap.

Prior art vacuum pumps which include an axial turbomolecular compressor and a molecular drag compressor provide generally satisfactory performance under a variety of conditions. Nonetheless, improvements are desired. One source of performance degradation that occurs in the molecular drag stages is backward leakage through the gaps between the rotor disk and the stator. In a specific example, gas may leak from the outlet of the molecular drag stage through the gap between the stationary baffle and the rotor disk to the inlet, thus reducing the achievable pressure ratio of the pumping stage. Leakage can be reduced by reducing the dimension of the gap between the stationary baffle and the rotor disk. However, a reduction in gap dimension requires increased precision and thereby increases cost. Furthermore, very small gaps increase the risk of undesired contact between the rotor disk and the stator during operation.

Accordingly, there is a need for improved molecular drag vacuum pumps which have a low level of backward leakage.

SUMMARY OF THE INVENTION

According to a first aspect of the invention, a molecular drag compressor comprises a rotor disk coupled to a drive shaft for rotation about an axis, a stator disposed about the rotor disk, the stator defining a tangential flow channel, an inlet to the tangential flow channel and an outlet from the tangential flow channel, and a stationary baffle disposed in the tangential flow channel adjacent to the outlet. The baffle and the rotor disk have a gap between them. A surface of the baffle facing the rotor disk has cavities configured to produce turbulent gas flow through the gap between the baffle and the rotor disk and to thereby reduce leakage.

According to a second aspect of the invention, an integral high vacuum pump comprises a pump housing having an axis, an axial turbomolecular compressor disposed in the housing and coupled to a motor drive shaft, and a molecular drag compressor disposed in the housing and coupled to the motor drive shaft. The molecular drag compressor includes at least one molecular drag stage comprising a rotor disk coupled to the motor drive shaft for rotation about an axis, a stator disposed around the rotor disk, the stator defining a tangential flow channel, an inlet to the tangential flow channel, an outlet from the tangential flow channel, and a stationary baffle disposed in the tangential flow channel adjacent to the outlet. The baffle and the rotor disk have a gap between them. A surface of the baffle facing the rotor disk has cavities configured to produce turbulent gas flow through the gap between the baffle and the rotor disk and to thereby reduce leakage.

According to a third aspect of the invention, a method is provided for operating a molecular drag compressor, which includes a rotor disk coupled to a drive shaft, stator disposed around the rotor disk, the stator defining a tangential flow channel, an inlet to the tangential flow channel and an outlet from the tangential flow channel, and a stationary baffle disposed in the tangential flow channel adjacent to the outlet, the baffle and the rotor disk having a gap between them. The method comprises producing turbulent gas flow through the gap between the baffle and the rotor disk to thereby reduce leakage.

BRIEF DESCRIPTION OF THE DRAWINGS

For a better understanding of the present invention, reference is made to the accompanying drawings, which are incorporated herein by reference and in which.

DETAILED DESCRIPTION OF THE INVENTION

Figure 1:
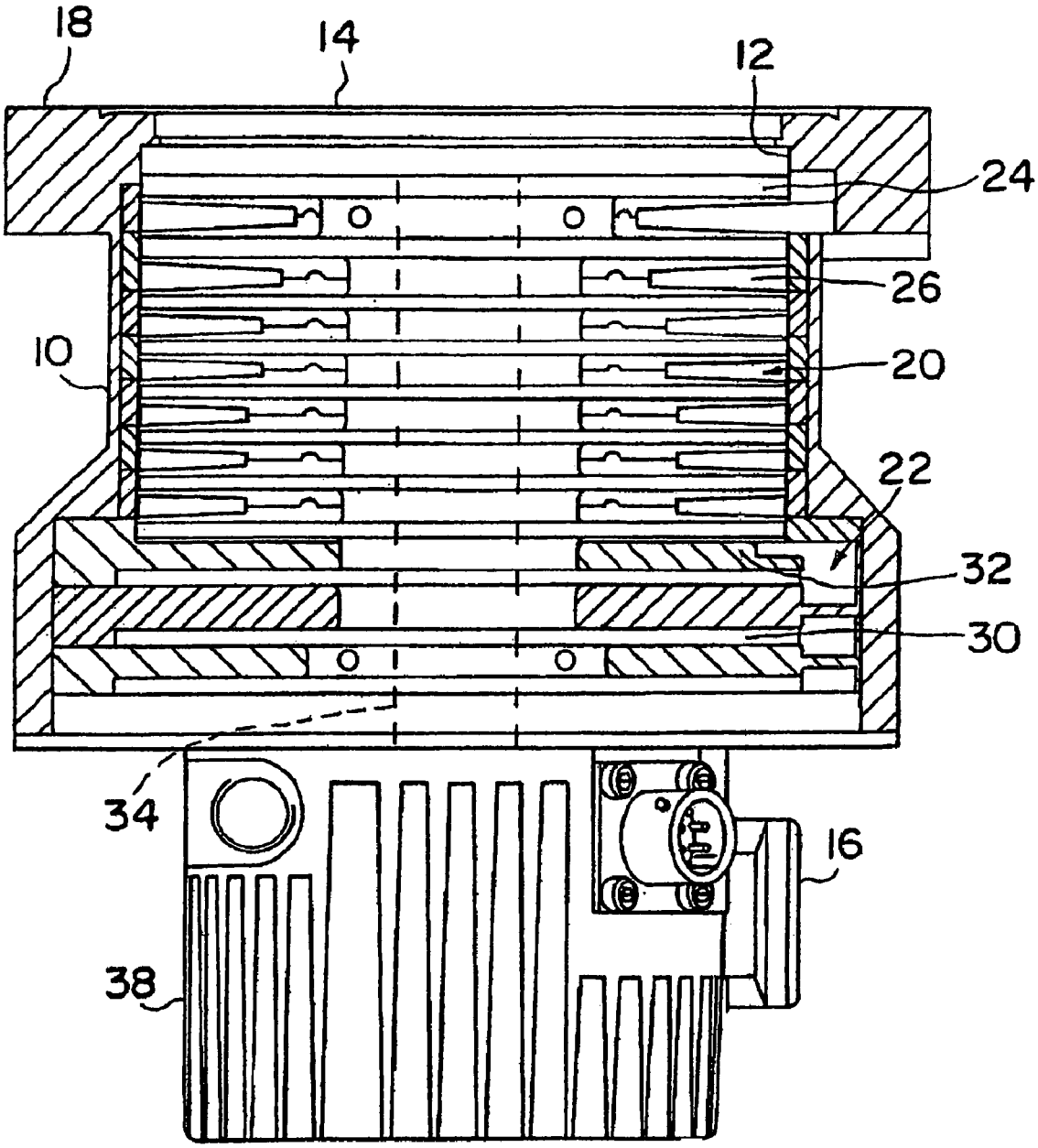
FIG. 1 is a cross-sectional elevation view of a high vacuum pump which includes an axial turbomolecular compressor and a molecular drag compressor.

An integral high vacuum pump suitable for incorporation of the present invention is shown in FIG. 1. A housing 10 defines an interior chamber 12 having an inlet port 14 and an exhaust port 16. The housing 10 includes a vacuum flange 18 for sealing the inlet port 14 to a vacuum chamber (not shown) to be evacuated. The exhaust port 16 is typically connected to a roughing vacuum pump (not shown). In cases where the vacuum pump is capable of exhausting to atmospheric pressure, the roughing pump is not required. Located within housing 10 is an axial turbomolecular compressor 20, which typically includes several axial turbomolecular stages, and a molecular drag compressor 22, which typically includes several molecular drag stages. In general, axial turbomolecular compressor 20 includes one or more axial turbomolecular stages, and molecular drag compressor 22 includes one or more molecular drag stages.

Each stage of the axial turbomolecular compressor 20 includes a rotor 24 and a stator 26. Each rotor and stator has inclined blades as known in the art. Each stage of the molecular drag compressor 22 includes a rotor disk 30 and a stator 32. The molecular drag compressor 22 is described in more detail below. The rotor 24 of each turbomolecular stage and the rotor 30 of each molecular drag stage are attached to a drive shaft 34. The drive shaft 34 is rotated at high speed by a motor located in a motor housing 38.

Figure 2:
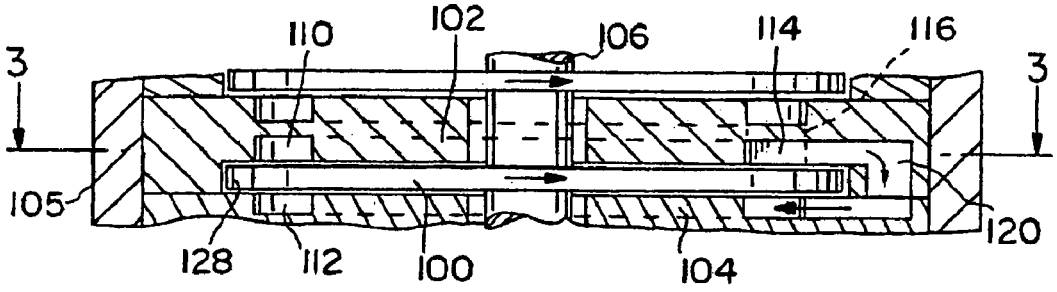
FIG. 2 is a cross-sectional elevation view of a first configuration of a molecular drag vacuum pumping stage.
Figure 3:
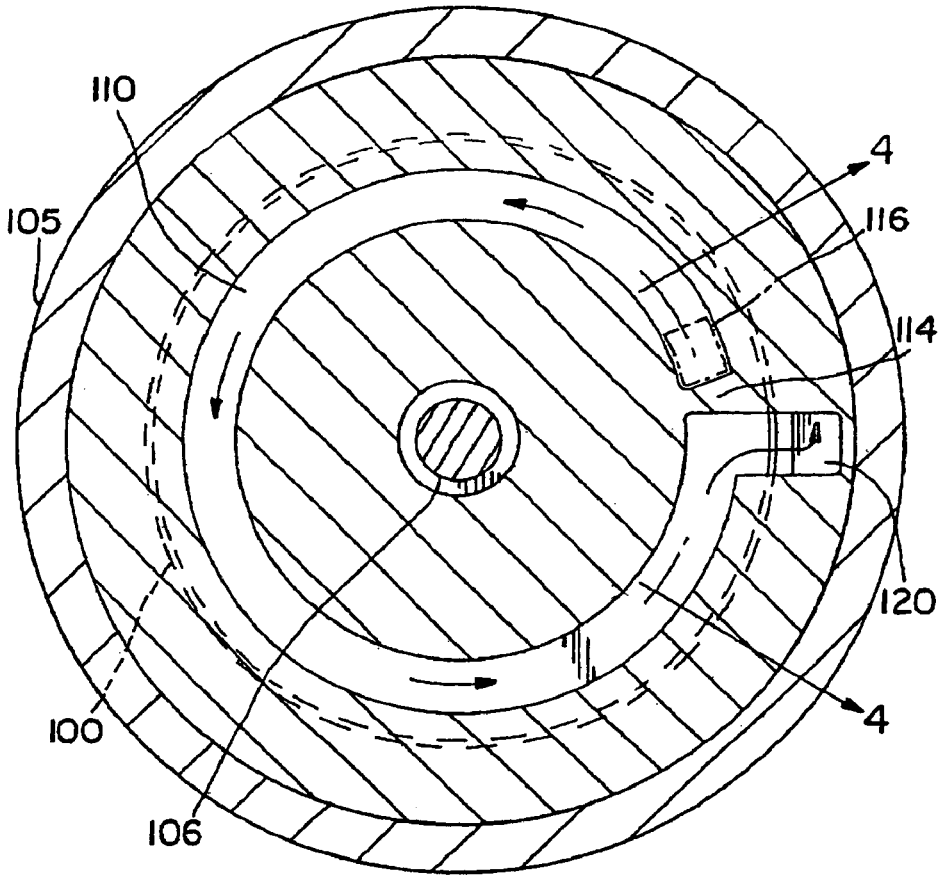
FIG. 3 is a cross-sectional plan view of the molecular drag stage, taken along the line 3—3 of FIG. 2.
Figure 4:
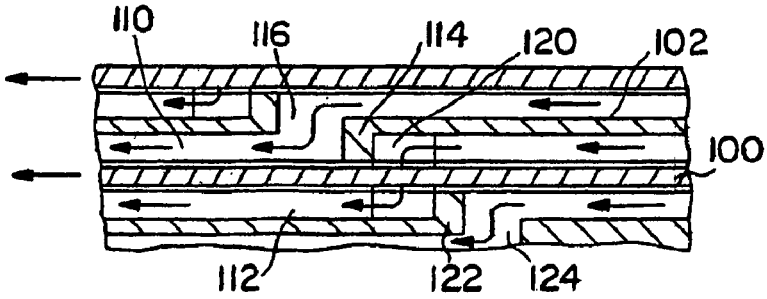
FIG. 4 is a partial, cross-sectional elevation view of the molecular drag stage, taken along the line 4—4 of FIG. 3.

A first configuration of the molecular drag compressor 22 is shown in FIGS. 2–4. In the molecular drag compressor, the stator is provided with one or more tangential flow channels. Each tangential flow channel has an inlet and an outlet separated by a stationary baffle. When the disk is rotated at high speed, gas is pumped through the tangential flow channel by molecular drag produced by the rotor disk.

As shown in FIGS. 2–4, a molecular drag stage includes a rotor disk 100, an upper stator portion 102 and a lower stator portion 104 mounted within a housing 105. The upper stator portion 102 is located in proximity to an upper surface of disk 100, and lower stator portion 104 is located in proximity to a lower surface of disk 100. The upper and lower stator portions 102 and 104 together constitute the stator for the molecular drag stage. The rotor disk 100 is attached to a shaft 106 for rotation at high speed.

The upper stator portion 102 has an upper tangential flow channel 110 located in opposed relationship to the upper surface of disk 100. The lower stator portion 104 has a lower tangential flow channel 112 located in opposed relationship to the lower surface of disk 100. In the configuration of FIGS. 2–4, the tangential flow channels 110 and 112 are circular and are concentric with the disk 100. The upper stator portion 102 includes a stationary baffle 114 which blocks tangential flow channel 110 at one circumferential location. The channel 110 receives gas from a previous stage through an inlet 116 on one side of baffle 114. The gas is pumped through the tangential flow channel 110 by molecular drag produced by the rotor disk 100. At the other side of baffle 114, a conduit 120, formed in stator portions 102 and 104, interconnects channels 110 and 112 around the outer peripheral edge of disk 100. The lower stator portion 104 includes a stationary baffle 122 which blocks lower tangential flow channel 112 at one circumferential location. The lower channel 112 receives gas on one side of baffle 122 through conduit 120 from the upper surface of disk 100 and discharges gas to the next stage through a conduit 124 on the other side of baffle 122.

In operation, gas is received from the previous stage through conduit 116. The previous stage can be a molecular drag stage, an axial turbomolecular stage, or any other suitable vacuum pumping stage. The gas is pumped around the circumference of upper tangential flow channel 110 by molecular drag produced by rotation of disk 100. The gas then passes through conduit 120 around the outer periphery of disk 100 to lower tangential flow channel 112. The gas is then pumped around the circumference of lower tangential flow channel 112 by molecular drag and is exhausted through conduit 124 to the next stage or to the exhaust port of the pump. In the configuration illustrated in FIGS. 2–4, upper channel 110 and lower channel 212 are connected such that gas flows through the upper and lower channels in series. Also in the configuration of FIGS. 2–4, the upper tangential flow channel 100 and the lower tangential flow channel 212 are spaced inwardly from the outer peripheral edge of disk 100. This configuration limits leakage between channels 110 and 112 around the outer edge of disk 100, except through conduit 120.

Figure 5A:
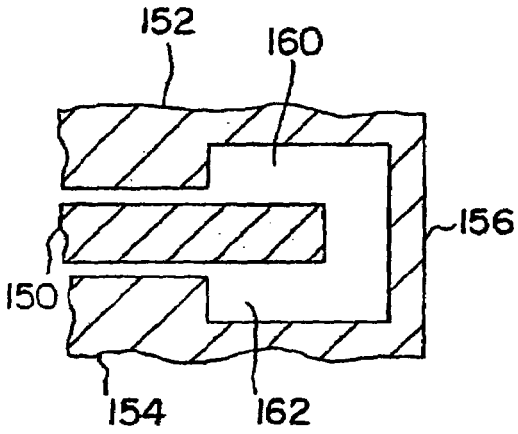
FIG. 5A is a partial cross-sectional view of a second configuration of a molecular drag vacuum pumping stage, showing the tangential flow channel.
Figure 5B:
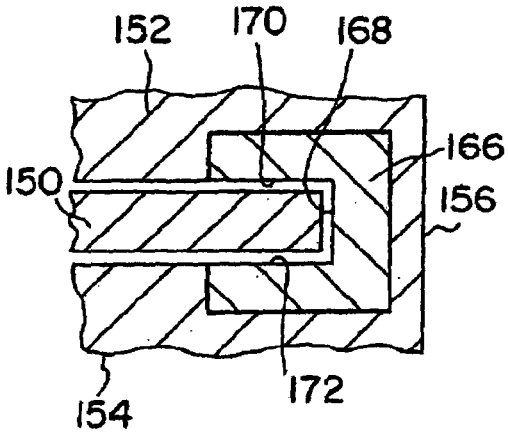
FIG. 5B is a partial cross-sectional view of the molecular drag stage of FIG. 5A, showing the stationary baffle between the inlet and the outlet.

A second configuration of the molecular drag stage is shown in FIGS. 5A and 5B. A partial cross-sectional view of the molecular drag stage near the outer periphery of the rotor disk is shown. In the configuration of FIGS. 5A and 5B, a rotor disk 150 is positioned between an upper stator portion 152 and a lower stator portion 154. The upper stator portion 152 defines an upper tangential flow channel 160 above rotor disk 150, and the lower stator portion 154 defines a lower tangential flow channel 162 below rotor disk 150. A peripheral stator portion 156 is spaced from the outer periphery of rotor disk 150, so that upper and lower tangential flow channels 160 and 162 are effectively connected in parallel. As shown in FIG. 5B, a stationary baffle 166 is positioned in tangential flow channels 160 and 162 at one circumferential location so as to substantially block gas flow between the inlet and outlet, except through each tangential flow channel.

Figure 6A:
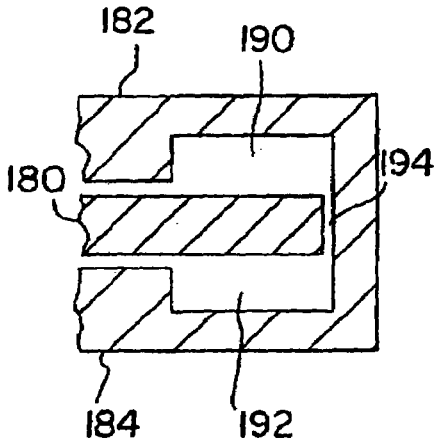
FIG. 6A is a partial cross-sectional view of a third configuration of a molecular drag vacuum pumping stage, showing the tangential flow channel.
Figure 6B:
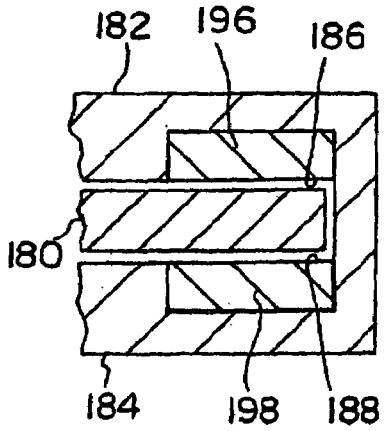
FIG. 6B is a partial cross-sectional view of the molecular drag stage of FIG. 6A, showing the stationary baffle between the inlet and the outlet.

A third configuration of the molecular drag stage is shown in FIGS. 6A and 6B. A partial cross-sectional view of the molecular drag stage near the outer periphery of the rotor disk is shown. A rotor disk 180 is positioned between an upper stator portion 182 and a lower stator portion 184. The upper stator portion 182 defines an upper tangential flow channel 190, and the lower stator portion 184 defines a lower tangential flow channel 192. A small gap 194 between the outer periphery of rotor disk 180 and a peripheral stator portion 186 permits rotation of rotor disk 180 but substantially blocks gas flow between tangential flow channels 190 and 192. Thus, tangential flow channels 190 and 192 may be connected in series. As shown in FIG. 6B, a stationary baffle 196 is positioned in upper tangential flow channel 190 at one circumferential location, and a stationary baffle 198 is positioned in lower tangential flow channel 192 at one circumferential location. Each of the stationary baffles 196 and 198 is positioned between the inlet and the outlet of the respective tangential flow channel and substantially blocks gas flow between the inlet and the outlet, except through each tangential flow channel.

It will be understood that the tangential flow channels of a molecular drag stage may have a variety of configurations and shapes. However, in each case, a stationary baffle is typically positioned at one circumferential location of the tangential flow channel to substantially block direct gas flow between the inlet and the outlet, except through the tangential flow channel. Nonetheless, some gas leaks through the gap between the rotor disk and the stationary baffle. Such backward leakage through the gap between the rotor disk and the stationary baffle degrades the performance of the vacuum pump.

Figure 7:
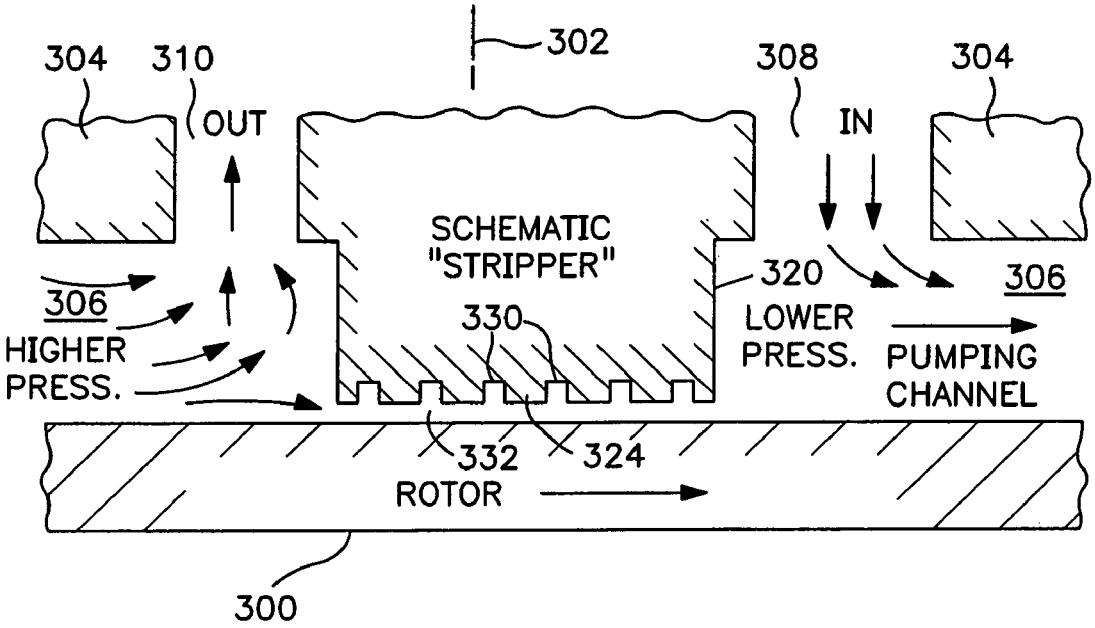
FIG. 7 is a partial, schematic, cross-sectional elevation view of a molecular drag stage, showing a baffle having cavities for producing gas turbulence in accordance with a first embodiment of the invention.

An aspect of the invention is illustrated with reference to FIGS. 7 and 8. Partial schematic elevation and plan views, respectively, of a molecular drag stage are shown. A rotor disk 300 rotates about an axis 302. A stator 304 positioned above rotor disk 300 defines a tangential flow channel 306. The stator 304 further defines an inlet 308 to tangential flow channel 306 and an outlet 310 from tangential flow channel 306. A stationary baffle 320 is disposed in tangential flow channel 306 adjacent to outlet 310. The baffle 320 may, but is not required to be, an integral part of stator 304.

A surface 324 of baffle 320 facing rotor disk 300 is provided with cavities 330. Rotor disk 300 is spaced from surface 324 by a gap 332 and moves relative to surface 324 during operation of the vacuum pump. Cavities 330 extend from surface 324 into stationary baffle 320 and are configured to reduce gas flow through gap 332 between rotor disk 300 and stationary baffle 320 in comparison with the case where surface 324 is flat. Cavities 330 effectively produce turbulence in the gas flow through gap 332 and thereby reduce the volume of gas flow. Cavities 330 may have a variety of configurations within the scope of the invention.

The cavities in the surface of baffle 320 reduce the transfer of pumped gas through gap 332. By providing cavities in the surface of the baffle, the gas flow in the gap becomes turbulent and therefore is reduced. The cavities can be configured using multiple grooves, holes, or dimples in the surface the baffle facing the rotor disk.

The shape of cavities 330 depends on the dimension of gap 332, i.e., the spacing between rotor disk 300 and surface 324 of baffle 320. The gap is typically in a range of 0.125 to 0.250 millimeter, but is not limited to this range. The total area of cavities 330 is preferably in a range of 30 to 70 percent of the total area of surface 324 facing rotor disk 300. The cavities 330 preferably have dimensions that are 1 to 10 times larger than the gap between baffle 320 and rotor disk 300. The ratios of the typical depths of the cavities to their lateral dimensions should preferably be near unity, although the depth can be larger without significant effect.

Figure 8:
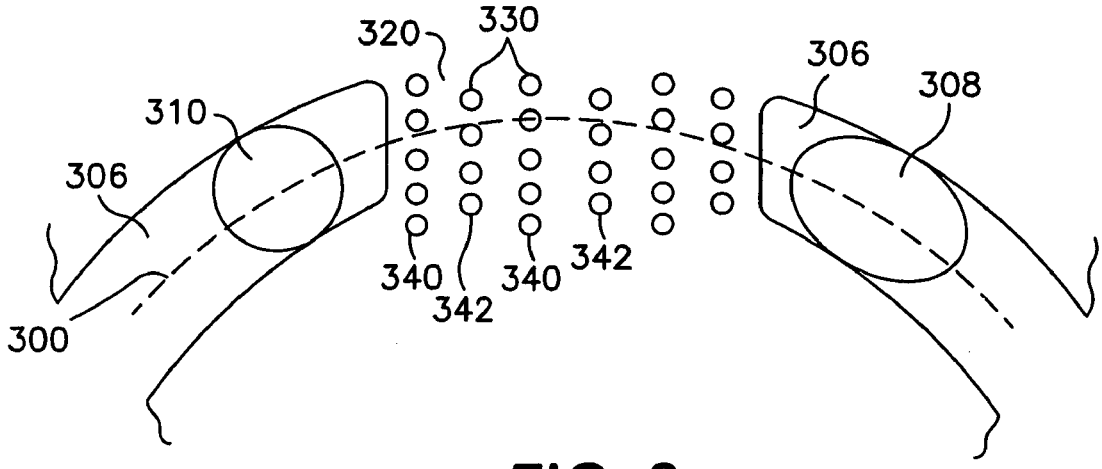
FIG. 8 is a partial, cross-sectional plan view of the molecular drag stage of FIG. 7.
Figure 9:
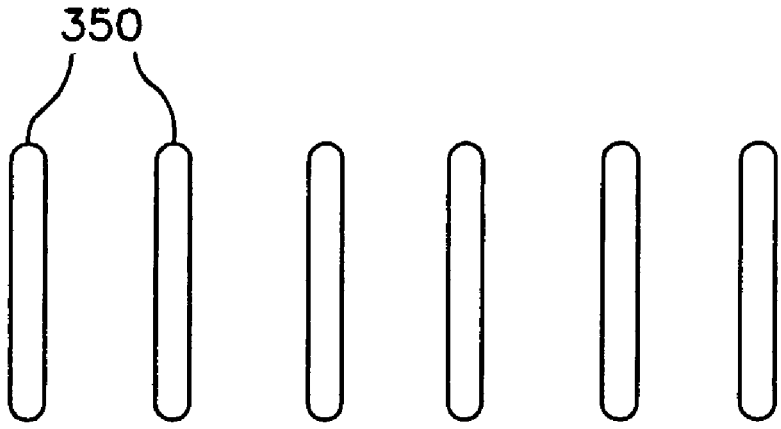
FIG. 9 is a partial, schematic plan view of a baffle, showing a pattern of cavities in accordance with a second embodiment of the invention.
Figure 10:
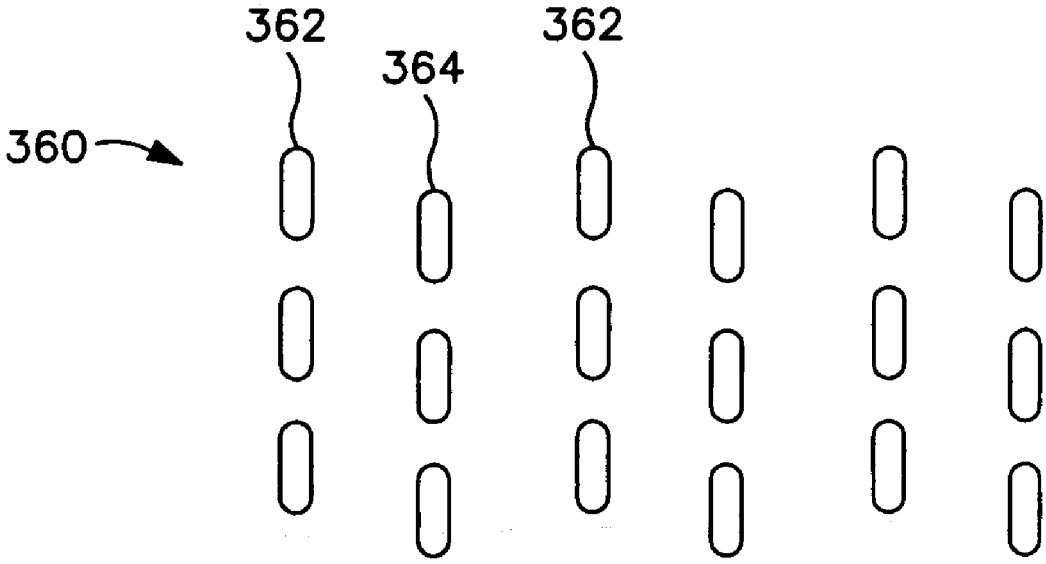
FIG. 10 is a partial, schematic cross-sectional plan view of a molecular drag stage, showing a stationary baffle having a pattern of cavities in accordance with a third embodiment of the invention.

The cavities can be simple cylindrical holes in staggered rows, as shown in FIG. 8. Thus, rows 340 are offset from rows 342 in a direction orthogonal to the direction of rotation of rotor disk 300. In other embodiments, the cavities 330 can be semi-circular, semi-oval, triangular, rectangular or square in cross-section. FIG. 9 shows elongated cavities 350 having long dimensions oriented generally orthogonally to the direction of rotation of rotor disk 300. FIG. 10 shows rectangular cavities 360 arranged in staggered rows 362 and 364. The lateral dimension of the cavities is preferably in a range of 0.25 to 1.25 millimeters.

Having described several embodiments and an example of the invention in detail, various modifications and improvements will readily occur to those skilled in the art. Such modifications and improvements are intended to be within the spirit and the scope of the invention. Furthermore, those skilled in the art would readily appreciate that all parameters listed herein are meant to be exemplary and that actual parameters will depend upon the specific application for which the system of the present invention is used. Accordingly, the foregoing description is by way of example only and is not intended as limiting. The invention is limited only as defined by the following claims and their equivalents.

What is claimed is:

1. A molecular drag compressor comprising:

a rotor disk coupled to a drive shaft for rotation about an axis;

a stator disposed around said rotor disk, said stator defining a tangential flow channel, an inlet to said tangential flow channel and an outlet from said tangential flow channel; and a stationary baffle disposed in said tangential flow channel adjacent to said outlet, said baffle and said rotor disk having a gap between them, a surface of said baffle facing said rotor disk having cavities configured to produce turbulent gas flow through the gap between said baffle and said rotor disk and to thereby limit gas flow in a circumferential direction from said outlet to said inlet through the gap between said baffle and said rotor disk.

2. The molecular drag compressor as defined in claim 1, wherein the cavities in said baffle are square, rectangular, triangular, semi-circular or semi-oval in cross section.

3. The molecular drag compressor as defined in claim 1, wherein the cavities in said baffle have depths equal to or greater than lateral dimensions of the cavities.

4. The molecular drag compressor as defined in claim 1, wherein the cavities in said baffle are configured as two or more rows of cavities generally orthogonal to a direction of disk rotation.

5. The molecular drag compressor as defined in claim 4, wherein the rows of cavities are staggered orthogonally with respect to the direction of disk rotation.

6. The molecular drag compressor as defined in claim 1, wherein the cavities cover 30 to 70 percent of the surface of said baffle facing said rotor disk.

7. The molecular drag compressor as defined in claim 1, wherein the cavities in said baffle have dimensions that are 1 to 10 times larger than the gap between said baffle and said rotor disk.

8. An integral high vacuum pump comprising:

a pump housing having an axis;

an axial turbomolecular compressor disposed in said housing and coupled to a motor drive shaft; and a molecular drag compressor disposed in said housing and coupled to the motor drive shaft, said molecular drag compressor including at least one molecular drag pumping stage comprising:

a rotor disk coupled to the motor drive shaft for rotation about an axis;

a stator disposed around said rotor disk, said stator defining a tangential flow channel, an inlet to said tangential flow channel, and an outlet from said tangential flow channel; and a stationary baffle disposed in said tangential flow channel adjacent to said outlet, said baffle and said rotor disk having a gap between them, a surface of said baffle facing said rotor disk having cavities configured to produce turbulent gas flow through the gap between said baffle and said rotor disk and to thereby limit gas flow in a circumferential direction from said outlet to said inlet through the gap between said baffle and said rotor disk.

9. The integral high vacuum pump as defined in claim 8, wherein the cavities in said baffle are square, rectangular, triangular, semi-circular or semi-oval in cross section.

10. The integral high vacuum pump as defined in claim 8, wherein the cavities in said baffle have depths equal to or greater than lateral dimensions of the cavities.

11. The integral high vacuum pump as defined in claim 8, wherein the cavities in said baffle are configured as two or more rows of cavities generally orthogonal to a direction of disk rotation.

12. The integral high vacuum pump as defined in claim 11, wherein the rows of cavities are staggered orthogonally with respect to the direction of disk rotation.

13. The integral high vacuum pump as defined in claim 8, wherein the cavities cover 30 to 70 percent of the surface of said baffle facing said rotor disk.

14. The integral high vacuum pump as defined in claim 8, wherein the cavities in said baffle have dimensions that are 1 to 10 times larger than the gap between said baffle and said rotor disk.

15. A method for operating a molecular drag compressor, including a rotor disk coupled to a drive shaft, a stator disposed around the rotor disk, the stator defining a tangential flow channel, an inlet to the tangential flow channel and an outlet from the tangential flow channel, and a stationary baffle disposed in the tangential flow channel adjacent to the outlet, the baffle and the rotor disk having a gap between them, comprising the step of:

producing turbulent gas flow through the gap between the baffle and the rotor disk to thereby limit gas flow in a circumferential direction from said outlet to said inlet through the gap between the baffle and the rotor disk.

16. The method as defined in claim 15, wherein producing turbulent gas flow includes forming cavities in a surface of the baffle facing said rotor disk.

17. The method as defined in claim 16, wherein forming cavities includes forming cavities in the baffle that are square, rectangular, semi-circular or semi-oval in cross section.

* * * * *